US006726315B2

(12) United States Patent
Koizumi et al.

(10) Patent No.: US 6,726,315 B2
(45) Date of Patent: Apr. 27, 2004

(54) LIQUID SUPPLYING DEVICE AND LIQUID DISCHARGE RECORDING APPARATUS

(75) Inventors: Yutaka Koizumi, Kanagawa (JP); Yukuo Yamaguchi, Tokyo (JP); Takeshi Yamakubo, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/202,911

(22) Filed: Jul. 26, 2002

(65) Prior Publication Data

US 2003/0025773 A1 Feb. 6, 2003

(30) Foreign Application Priority Data

Aug. 1, 2001 (JP) ..... 2001/233465
Feb. 15, 2002 (JP) ..... 2002/039225

(51) Int. Cl.[7] ..... B41J 2/175
(52) U.S. Cl. ..... 347/85
(58) Field of Search ..... 347/85, 89, 92

(56) References Cited

U.S. PATENT DOCUMENTS 4,404,566 A * 9/1983 Clark et al. ..... 347/85
5,485,187 A * 1/1996 Okamura et al. ..... 347/85
6,082,851 A * 7/2000 Shihoh et al. ..... 347/85
6,561,637 B2 * 5/2003 Hino ..... 347/92

OTHER PUBLICATIONS

U.S. patent application No. 10/066,623, filed Feb. 6, 2002.

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

A liquid supply device for supplying liquid to a recording head is disclosed. The device includes a liquid container for holding liquid to be supplied to the recording head, a first connecting portion for connecting the recording head and the liquid container, and a second connecting portion having one end thereof in the liquid container, and the other end being open to the air outside and positioned lower in height than the liquid discharge port of the recording head. The device is capable of adjusting negative pressure against the nozzle of the recording head to prevent ink leakage without depending on the deformation of an ink bag.

6 Claims, 8 Drawing Sheets

LIQUID SUPPLYING DEVICE AND LIQUID DISCHARGE RECORDING APPARATUS

BACKGROUND OF THE INVENTION

1. Field of the Invention

The present invention relates to a liquid discharge recording apparatus that records on a recording material by discharging recording liquid. The invention also relates to a liquid supplying device used therefore.

2. Related Background Art

As a mode of a recording apparatus that forms images (characters, graphics, patterns, and the like are called images inclusively) on a recording material, such as recording sheet, there is an ink jet recording apparatus that discharges micro ink droplets from fine discharge ports. Generally, the ink jet recording apparatus provided with a recording head having nozzles used for discharge ink droplets, and an ink that contains ink to be supplied to the recording head. Then, ink is induced from the ink tank to the recording head, and the energy-generating element, such as heat generating element or piezoelectric element, which is installed near the discharge port of each nozzle of the recording head, is driven in accordance with recording signals to discharge ink droplets from each discharge port for recording by the adhesion thereof to a recording material. This ink jet recording apparatus is the so-called non-impact type recording apparatus that makes it possible to perform high-speed recording, and record on various kinds of recording mediums, and has an advantage, among others, that almost no noise is generated at the time of recording, thus being popularized and widely used.

For an ink jet recording apparatus of the kind, it is required to keep ink always under a negatively pressurized condition at the discharge port in order port, with the exception of a designated amount of micro ink droplets to be discharged, that is, to prevent ink leakage from the discharge port when driving is not given (recording on standby or the like), and also, to prevent any excessive ink flow out from the discharge port in the process of recording.

Conventionally, in order to keep ink under a negatively pressurized condition, a structure is adopted to make the height of the ink tank that contains ink lower than that of the discharge port for the utilization of water-level difference. Then, in order to keep the holding pressure of ink regulated by such water-head difference at a constant level under any circumstances, there is a need for the ink tank to be capable of changing the volume thereof in accordance with the amount of ink retained therein. For example, the structure should be arranged so that when the amount of ink inside the ink tank is reduced by a supply of ink to a recording head, the volume of the ink tank is reduced accordingly or when the amount of ink inside the ink tank is increased with a flow-in of ink from the recording head, the volume of the ink tank is increased accordingly. In generally, therefore, a flexible container, such as an aluminum-laminated bag, is used.

FIG. 8 is a view that schematically shows the structure of an ink jet recording apparatus provided with the conventional ink-supplying device. This apparatus has a recording head 110 of ink jet method that records by discharging ink, and an ink supplying device that supplies ink to the recording head 110.

The ink supplying device is provided with an aluminum-laminated flexible bag (ink tank) 210; a tank case 200, which is a highly robust housing to cover the aluminum-laminated bag 210; an ink supply tube 170, which is a pipe type connecting member to supply ink from the aluminum-laminated bag 210 to the recording head 110; and a joint 190 that couples the ink supply tube 170 with the aluminum-laminated bag 210.

The recording head 110 is provided with nozzles 150 that discharge ink; a common liquid chamber 140 serving as a pool to supply ink evenly to each of the nozzles 150; a sub-tank 120 that provisionally retains ink supplied from the ink supplying device before being supplied to the common liquid chamber 140; a filter 130 for removing dust particles contained in ink supplied from the sub-tank 120 to the common liquid chamber 140; and ink suction tube 180 for sucking ink by use of a pump (not shown) when ink is supplied for the first time to a recording head yet to be used.

For this ink jet recording apparatus, the aluminum-laminated bag 210 is filled with ink to form a closed space where no air is present. Ink is supplied to the recording head 110 from the aluminum-laminated bag 210 through the joint 190 and the ink supply tube 170. Inside the recording head 110, a certain amount of ink is retained in the sub-tank 120. Then, from the sub-tank 120, ink is supply to each of the nozzles 150 through the common liquid chamber 140. The sub-tank 120 is not filled with ink up to its total capacity, but there is a remaining portion to enable the air to be accumulated. Also, a rubber plug, valve, or the like (not shown) is used here to airtightly close the ink suction tube 180 so as not to allow ink leakage. At the tip of each nozzle 150, meniscus of ink 160 is formed, and by the surface tension of the meniscus 160, ink is held near the discharge port at the tip of nozzle 150 so as not to allow it to drop down. At this juncture, the aluminum-laminated bag 210 is positioned lower than the recording head 110 to generate a water-head difference h between the discharge port at the tip of nozzle 150 and the ink outlet of the aluminum-laminated bag 210 (the portion where the joint 190 is installed) so that the meniscus of ink 160 is positioned appropriately inside the nozzle 150, while making it possible to prevent ink from being dropped down by enabling the surface tension work appropriately.

In this conventional ink jet recording apparatus, when the inner temperature of the recording head 110 rises due to heat generation or the like along with the recording operation, the air in the sub-tank 120 expands to increase the inner pressure of the sub-tank 120. Then, ink in the sub-tank 120 flows inversely to the ink tank 200 through the ink supply tube 170, thus eliminating the pressure increase in the sub-tank 120. The ink thus inversely flows is contained in the aluminum-laminated bag 210. The aluminum-laminated flexible bag is deformed to swell. In this way, it deals with the increased amount of ink along with the inverse flow of ink form the recording head 110. As a result, the negatively pressurized condition of ink in the recording head 110 is kept at a constant level, and no change occurs in the meniscus 160 that prevents ink from being dropped down.

Also, in the ink jet recording apparatus, when ink inside the recording head 110 is consumed by the recording operation, ink inside the sub-tank 120 is reduced to lower the pressure in the sub-tank 120. Therefore, the ink inside the aluminum-laminated bag 210 flows in the sub-tank 120 through the ink supply tube 170 to eliminate lowering the pressure in the sub-tank 120. In this way, ink in the aluminum-laminated bag 210 is reduced to deform the aluminum-laminated flexible bag 210 for the performance of smooth ink supply.

In this manner, by the flow of ink between the sub-tank 120 and the aluminum-laminated bag 210, it is possible to keep the negatively pressured condition of ink in the recording head 110 at a constant level. In other words, the increase or decrease of pressure in the recording head 110 and in the entire system of the ink supplying device is absorbed by the increase or decrease of the capacity resulting from the deformation of the aluminum-laminated bag 210.

As described above, for the conventional ink jet recording apparatus, pressure exerted on ink is adjusted by the deformation of the aluminum-laminated flexible bag 210 in order to prevent ink from dropping down, while making the smooth ink supply possible. Therefore, it is required for the aluminum-laminated bag 210 to be flexible and deformable. Further, in order not to impede the deformation of the aluminum-laminated bag 210, particularly, not to impede increasing volume thereof, it is required to provide a sufficient space around the aluminum-laminated bag 210. For example, in the structure shown in FIG. 8, the tank case 200 that surrounds the aluminum-laminated bag 210 should be formed to provide a large volume so as not to impede a large swelling of the aluminum-laminated bag 210. This is the cause that the entire size of an ink jet recording apparatus should be made larger inevitably.

Meanwhile, in recent years, an ink jet recording apparatus is used even in a case where a large amount of prints is needed along with the higher speed capability, higher durability, quietness, lower running costs, and other enhanced performance, which are made available for an ink jet recording apparatus. It is also required to make the capacity of an ink tank larger to retain more ink accordingly. The ink jet recording method also makes it easier to provide images in colors, and in recent years, most of ink jet recording apparatus can record in colors. As a result, not only one black color, but also, ink of many colors, such as four colors, six colors, or seven colors, are needed, thus requiring many numbers of large-volume ink tanks to serve the purpose. This naturally causes an ink jet recording apparatus to be made larger eventually. Under such circumstances, the conventional structure as shown in FIG. 8 that uses the aluminum-laminated flexible bag 210 or some other deformable ink tank, and requires the security of space outside the ink tank, becomes extremely unfavorable in terms of the voluminal efficiency in retaining ink. As compared with the capacity of retainable ink, the volume that such pace occupies in the ink supply device is large.

As described above, there are many causes overlapping that make the conventional ink jet recording apparatus larger inevitably, and the status quo is such that it is extremely difficult to meet the requirement of downsizing and lighter weight of the apparatus for which the serviceability or the like is taken into consideration. Ultimately, for the conventional ink jet recording apparatus, it is utterly impossible to make compatible the capability of printing in a large quantity or recording in colors finely, which requires a large size of the apparatus inevitably, and the capability of enhancing serviceability, which means downsizing and making the apparatus lighter.

SUMMARY OF THE INVENTION

Now, it is an object of the present invention to provide an ink supplying device (liquid supplying device) capable of adjusting negative pressure against the nozzle of a recording head to prevent ink from dropping down, among some others, without depending on the deformation of an ink tank in the system to supply ink from an ink tank to an ink jet head, and capable of contributing to downsizing the device as compared with the conventional structure, and also, to provide an ink jet recording apparatus (liquid discharge recording apparatus) that uses such ink supplying device.

In order to achieve the aforesaid object, the liquid supplying device of the present invention for supplying liquid to a recording head for discharging liquid comprises a liquid container (ink tank) for containing liquid (ink) to be supplied to the recording head; a first connecting portion for connecting the recording head and the liquid container; and a second connecting portion having one end thereof in the liquid container, and the other end thereof being open to the air outside. For this ink supplying device, the one end of the second connecting portion connected with the liquid container is positioned lower than the height of liquid discharge port of the recording head, and an interface between liquid and the air outside exists in the second connecting portion, and by the surface tension of meniscus formed on the interface, negative pressure is generated against the liquid discharge port of the recording head.

For this liquid supplying device, it is preferable to position the other end of the second connecting portion opened to the air outside higher than the one end thereof, and also, to position the other end of the second connecting portion opened to the air outside lower than the height of the liquid discharge port of the recording head. It is also conceivable that the first connecting portion and the second connecting portion extend from the bottom face of the liquid container downward, and are bent upward on the way, respectively.

Further, it is preferable to install a buffer chamber between both ends of the second connecting portion to provisionally retain liquid overflowing from the liquid container. In this case, it is desirable to arrange a liquid absorbent in the buffer chamber or to arrange the atmosphere-opening hole provided for the buffer chamber to be downward.

The liquid supplying device thus structured keeps the negative pressure constantly with the movement of the interface in the second connecting portion following the pressure changes inside the liquid container and recording head.

Further, the first connecting portion supplies liquid from the liquid container to the recording head when liquid in the recording head is consumed, and the second connecting portion induces the air outside into the liquid container when pressure in the liquid container is reduced.

As described above, the liquid supplying device of the present invention is provided with a liquid container (ink tank) that contains liquid (ink) to be supplied to a recording head; a first connecting portion that connects the recording head and the liquid container; and a second connecting portion having one end thereof in the liquid container and the other end thereof being open to the air outside, and one end of the second connecting portion connected with the liquid container is positioned lower than the height of the liquid discharge port of the recording head. Then, the structure is arranged so that there exists an interface between liquid and the air outside in the second connecting portion, and by the surface tension of meniscus formed on this interface, negative pressure is generated against the liquid discharge port of the recording head. In this way, liquid is prevented from being dropped down form the discharge port of the recording head. Further, it is arranged to move the interface in the second connecting portion in accordance with the changes in pressure in the liquid container and recording head so as to keep the negative pressure constantly. Therefore, it is unnecessary for the liquid container to deform. It can be a simple housing. The restriction of usable materials is small accordingly, and the manufacture is also simpler and executable at lower costs. Then, liquid can be filled in the liquid container up to its capacity, while it is unnecessary to secure space surrounding the liquid container, hence making efficiency extremely favorable in containing liquid. Also, there is no need for making the liquid supply device too large, thus contributing to saving space in the liquid discharge recording apparatus provided with this liquid supplying device.

Also, an liquid discharge recording apparatus, which is provided with the liquid supply device described above, and a recording head, and which performs recording by discharging liquid form the recording head to a recording medium, belongs to the present invention. With the structure thus arranged, it is unnecessary to make the liquid supplying device larger, thus implementing downsizing the liquid discharge apparatus as a whole. It is particularly effective for the liquid discharge recording apparatus that performs recording in a large quantity or fine color recording.

Also, with the provision of a buffer chamber that retains liquid provisionally between both ends of the second connecting portion, the buffer chamber functions to be receptacle for liquid that may be pushed out of the liquid container due to the expansion of air in the liquid container when temperature rises, thus preventing the inside of the recording apparatus from being stained by liquid contained in the liquid container.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 1:
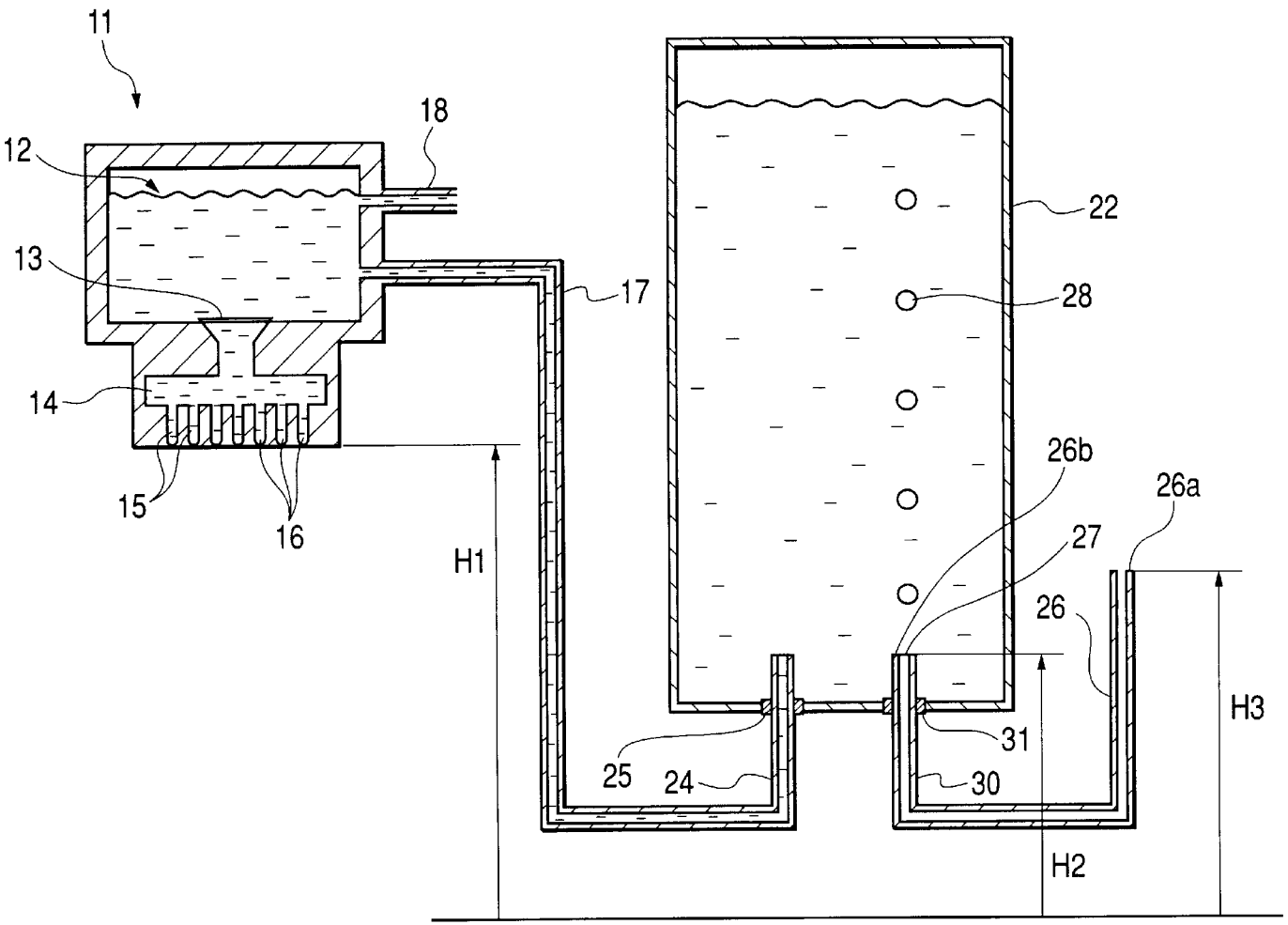
FIG. 1 is a view that schematically shows the structure of an ink discharge recording apparatus (ink jet recording apparatus) including a liquid supplying device (ink supplying device) in accordance of a first embodiment of the present invention.

FIG. 1 is a view that schematically shows the structure of an ink discharge recording apparatus including a liquid supplying device in accordance of a first embodiment of the present invention. This is an ink jet recording apparatus provided with a recording head 11 of ink jet method that records by discharging ink, and an ink supplying device that supplies ink to the recording head 11. Here, ink is exemplified as liquid used for the present embodiment, but the present invention is not necessarily thereto. The ink supplying device is arranged vertically downward, and provided with an ink tank 22 for retaining ink; an ink supply tube 17 serving as a first connecting portion of pipe type that supplies ink from the ink tank 22 to the recording head 11; and an atmosphere releasing tube 26 serving as a second connecting portion of pipe type that induces the air outside to the ink tank 22.

The ink tank 22 is formed by a highly robust housing that cannot be deformed easily, which is formed, for example, by polyethylene, polypropylene, Noryl, or the like in a thickness of 0.5 mm or more.

The ink supply tube 17 includes a pipe type needle portion 24 formed by stainless steel or the like. The needle portion 24 can be inserted into the inside of the ink tank 22 through a rubber plug 25 that clogs the hole portion provided for the bottom face of the ink tank 22. Likewise, the atmosphere releasing tube 26 includes a pipe type needle portion 30 formed by stainless steel or the like. The needle portion 30 can be inserted into the inside of the ink tank 22 through a rubber plug 31 that clogs the hole portion provided for the bottom face of the ink tank 22.

Also, the ink supply tube 17 is folded in the horizontal direction at the lower end of the vertically standing needle portion 24, and again folded upward, thus being connected with the inside of the head from the side wall in the vicinity of the bottom face of the sub-tank 12 of the recording head 11. On the other hand, the atmosphere releasing tube 26 is folded in the horizontal direction at the lower end of the vertically standing need portion 30, and again folded upward.

The opening portions arranged on the bottom face of the ink tank 22 are released as injection inlets when ink is injected into an unused ink tank 22. After ink is injected, rubber plugs 25 and 31 are used to clog the opening portions, respectively. As shown in FIG. 1, when the ink tank is installed on the recording apparatus main body, the needle portions 24 and 30 are inserted into the inside of the ink tank 22 through the rubber plugs 25 and 31, respectively. In this way, the ink tank 22 and the recording head 11 are communicated through the ink supply tube 17 (the first connecting portion) that includes the needle portion 24, while the inside of the ink tank 22 is released to the air outside through the atmosphere releasing tube 26 (the second connecting portion) that includes the needle portion 30. Before the ink tank 22 is installed on the recording apparatus main body or after removed from the recording apparatus main body, the rubber plugs 25 and 31 clog the opening portions. There is no possibility that ink flows out from the ink tank 22. At this juncture, holes are open due to the needle portions 24 and 30, but the needle portion 24 is withdrawn, the holes are clogged with the elasticity of the rubber plugs 25 and 31.

Figure 8:
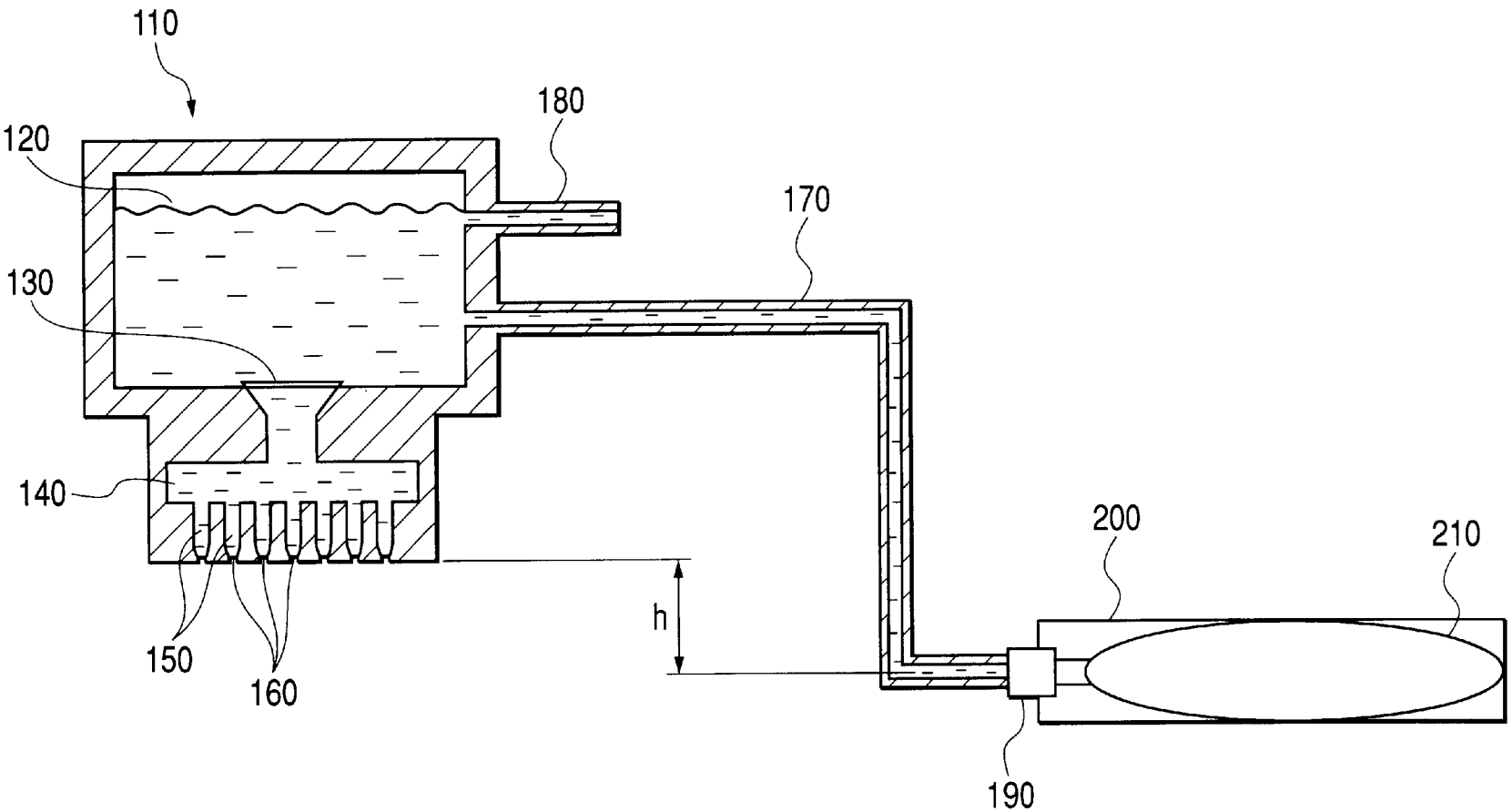
FIG. 8 is a view that schematically shows the principal part of an ink jet recording apparatus that includes the convention ink-supplying device.

The recording head 11 has substantially the same structure as the conventional recording head 110 shown in FIG. 8, which is provided with nozzles 15 that discharge ink; a common liquid chamber 14 serving as a pool to supply ink evenly to each of the nozzles 15; a sub-tank 12 that provisionally retains ink supplied from the ink supplying device before being supplied to the common liquid chamber 14; a filter 13 for removing dust particles contained in ink supplied from the sub-tank 12 to the common liquid chamber 14; and ink suction tube 18 for sucking ink by use of a pump (not shown) when ink is supplied for the first time to a recording head yet to be used. The recording head 11 is installed on the recording apparatus main body with the nozzles 15 downward so that the positions of the nozzles 15, common liquid chamber 14 and sub-tank 12 are arranged in line in the vertical direction.

For the ink jet recording apparatus, ink is supplied from the ink tank 22 to the recording head 11 through the ink supply tube 17. Inside the recording head 11, a certain amount of ink is retained in the sub-tank 12, and from the sub-tank 12, ink is supplied to each of the nozzles 15 through the common liquid chamber 14. The inside of the ink supply tube 17 that includes the needle portion 24 is filled with ink over the entire length. The sub-tank 12 is not filled in ink up to the total volume. It has a remaining portion where the air is accumulated. Also, the ink suction tube 18 is closed with a valve or the like (not shown) after it is used for ink suction to fill ink inside the recording head 11 so as not allow ink to leak. At each tip of nozzles 15, meniscus 16 of ink is formed, and by the surface tension of the meniscus 16, ink is held near the discharge port at the tip end of the nozzle 15 so as not to allow it to drop down.

In accordance with the present invention, the ink tank 22 may be filled with ink up to the total volume at the initiation of its use, but as ink is consumed, it shows the condition that there remains a portion where the air is accumulated, not the total volume thereof being filled with ink. Also, the leading end 26*b* of the atmosphere releasing tube 26 is positioned lower than the height of the liquid discharge port of nozzle 15 of the recording head 11. Then, inside the atmosphere releasing tube 26, there exists the interface between ink and air (the air outside). The meniscus 27 of ink is formed on this interface. In this way, under the normal use environment, a constant negative pressure is exerted on the nozzle 15 of the recording head 11 by the surface tension generated by the meniscus 27 in the atmosphere releasing tube 26, thus preventing ink leakage from the nozzle 15. At this juncture, the inner diameter of the atmosphere releasing tube 26 becomes important for the meniscus formation required for the generation of the aforesaid negative pressure. Here, the inner diameter of the atmosphere releasing tube 26 is set at a diameter of approximately 0.1 mm to 10 mm. More preferably, it is set at a diameter of approximately 0.1 mm to 2 mm.

In the ink jet recording apparatus thus structured, when the inner temperature of the recording head 11 rises due to heat generation along the recording operation, the air in the sub-tank 12 expands to cause the pressure in the sub-tank 12 to be increased. Then, ink in the sub-tank 12 inversely flows to the ink tank 22 through the ink supply tube 17 to eliminate the pressure increase in the sub-tank 12. The ink tank 22 retains ink that inversely flows. At this juncture, the pressure inside the ink tank 22 increases to press ink in the ink tank 22. Ink is then caused to enter the atmosphere releasing tube 26 deeply. In other words, the position of the meniscus 27 of ink is lowered. When the pressure increase is large, the atmosphere releasing tube 26 is bent, and conceivably, in some case, the meniscus 27 of ink moves even up to the middle portion that extends horizontally.

Also, for the ink jet recording apparatus, when ink in the recording head 11 is consumed for recording operation, ink in the sub-tank 12 is reduced to lower the pressure in the sub-tank 12. Here, then, ink in the ink tank 22 flows in the sub-tank 12 through the ink supply tube 17 to eliminate the pressure decrease inside the sub-tank 12. Along with this, ink in the ink tank 22 is reduced to lower the pressure inside the ink tank 22. Thus, the air outside is induced through the atmosphere releasing tube 26. As a result, bubbles 28 are fetched into the ink tank 22 to compensate for the amount of ink thus reduced. At this juncture, the meniscus 27 in the atmosphere releasing tube 26 is positioned at the leading end 26*b* of the atmosphere releasing tube 26 inside the ink tank 22 as shown in FIG. 1. After that, when an appropriate amount of bubbles (the air outside) 28 is fetched in, the pressure in the ink tank 22 is restored and stabilized, thus terminating the fetching of the air outside.

With such movement of the interface between ink and the air outside, that is, the meniscus 27, in the atmosphere releasing tube 26, the pressure fluctuation in the sub-tank 12 is absorbed to keep the negatively pressurized condition of ink constantly in the recording head 11. Thus, no change occurs in the meniscus 16 in the nozzle 15 that prevents ink from dropping down.

As shown in FIG. 8, the conventional ink-supplying device absorbs the pressure fluctuation by use of the aluminum-laminated bag 210 serving as an ink tank. Therefore, in order not to regulate the deformation of the aluminum-laminated bag 210, a sufficient space should be provided around the bag. Also, negative pressure is generated by means of the water head difference h, which is generated by the relative heights of the nozzle 150 of the recording head 110 and the aluminum-laminated bag 210. Consequently, there is automatically limit in the arrangement of the nozzle 150 and the aluminum-laminated bag 210.

In contrast, the ink supplying device of the present invention absorbs the pressure fluctuation by means of the movement of the meniscus 27 at the interface between ink and the air outside, which is generated in the atmosphere releasing tube 26 that releases the ink tank 22 to the air outside. Therefore, no deformation of ink tank 22 is needed, and there is no need for the provision of any particular space around the ink tank 22, either. The negative pressure needed for preventing ink leakage form the nozzle 15 is mainly dependent of the position of the discharge port at the leading end of the nozzle 15 of the recording head 11 and the position of the leading end 26*b* of the atmosphere leasing tube 26. Thus, there is nothing that regulates the size of the ink tank 22. Particularly, the positional relations between the nozzle 15 of the recording head 11 and the upper part of the ink tank 22 do not present anything that should be considered for regulation. Therefore, for example, even if the upper part of the ink tank 22 exists on the upper side of the nozzle 15 of the recording head 11, there is no problem encountered at all. The ink tank 22 is formed by a housing corresponding to the amount of ink to be contained, and ink can be contained up to the total volume thereof, hence making the ink-retaining efficiency extremely favorable.

Also, as understandable from FIG. 1, the positional relations between the position of the discharge port at the tip end of the nozzle 15 (height H1), the position of the leading end 26*b* of the atmosphere releasing tube 26 where meniscus is formed in normal use condition (height H2), and the position of the opening end 26*a* of the atmosphere releasing tube 26 (height H3) should satisfy relations given below in order to prevent the overflow of ink from the nozzle 15.

(1) At first, the positional relations between the discharge port of the nozzle 15 and the leading end 26*b* of the atmosphere releasing tube 26 of the ink tank 22 is set at H1>H2 as described above. With such positional relations, there is no possibility that ink flows out from the nozzle 15 of the recording head 11 of the liquid supplying device of the present embodiment under the usual circumstances of use, making it possible to perform stabilized discharges with the constant negative pressure exerted on the nozzle 15.

(2) Next, the positional relations between the leading end 26*b* of the atmosphere releasing tube 26 of the ink tank 22 and the opening end 26*a* of the atmosphere releasing tube 26 is set at H2<H3 as shown in FIG. 1.

If the temperature outside rises while the recording operation of a recording head is at rest, the air accumulated in the ink tank 22 expands. For the liquid supplying device of the present embodiment, there is no other alternative but to eliminate this expansion using the nozzle 15 or the opening end 26*a* of the atmosphere releasing tube 26.

However, with respect to the nozzle diameter of the nozzle 15 and the inner diameter (hole diameter) of the atmosphere releasing tube 26, the inner diameter of the atmosphere releasing tube 26 is made lager. As a result, the nozzle has an overwhelming ink holding power by the meniscus generated therefor. Therefore, the air expansion is eliminated when ink moves to the opening end 26*a* through the inside of the atmosphere releasing tube 26.

At this juncture, assuming that the positional relations are H2>H3 and if the meniscus 16 of the nozzle 15 should be broken by some disturbance from the outside, thus allowing the air outside to enter the nozzle 15, there is a fear that ink residing in the recording head 11 and ink tank 22 is all allowed to flow out from the hole of the opening end 26*b* of the atmosphere releasing tube 26. Therefore, in consideration of such event, it is desirable to set the positional relations at H2<H3.

(3) Further, the positional relations between the discharge port of the nozzle 15 and the opening end 26*a* of the atmosphere releasing tube 26 may present a problem if ink flows out from the nozzle 15 in a state where the temperature outside rises (in a state where ink is filled in almost up to the opening end 26*a* through the inside of the atmosphere releasing tube 26). Therefore, it is desirable to set the positional relations at H1>H3.

(Second Embodiment)

Figure 2:
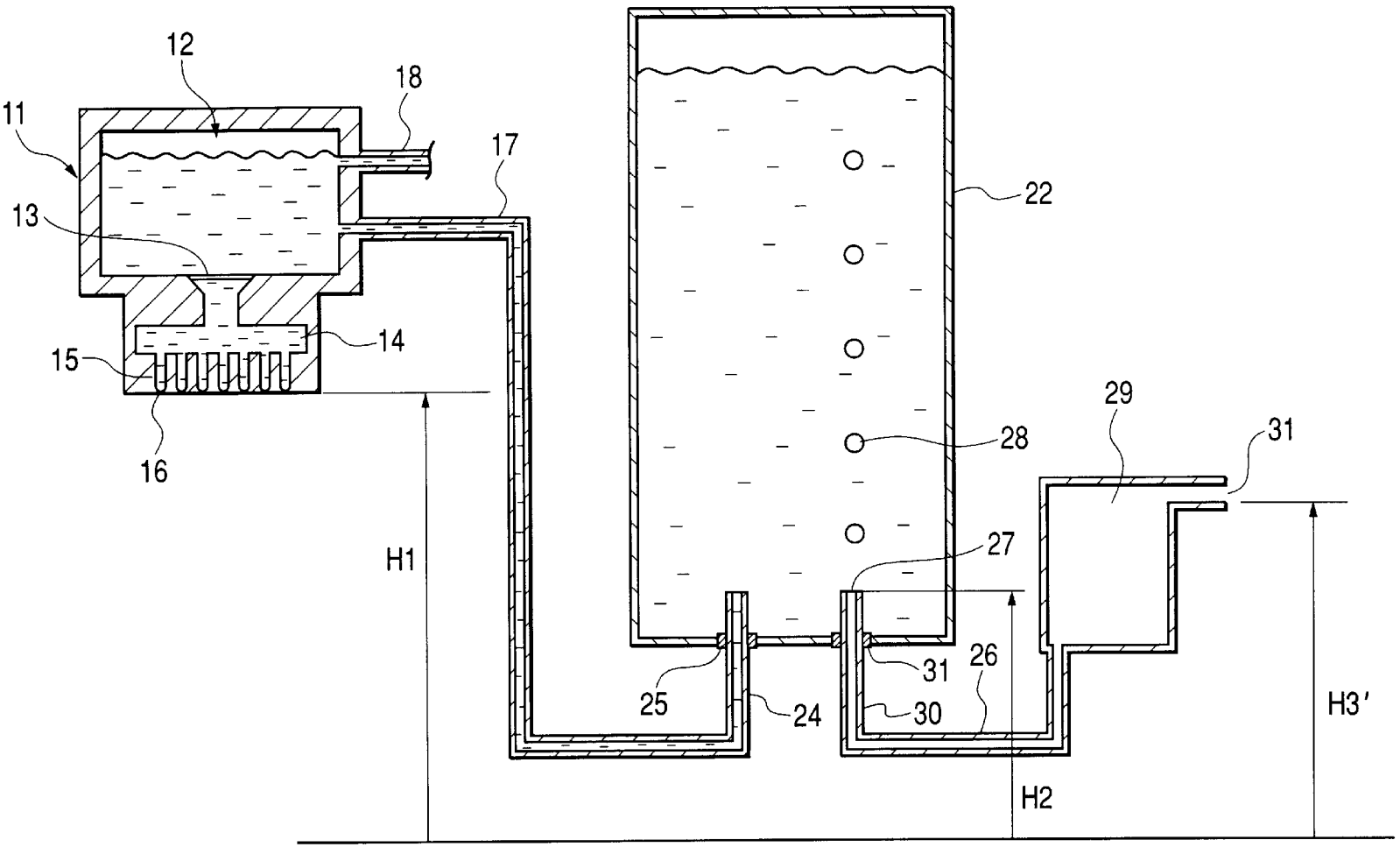
FIG. 2 is a view that schematically shows the structure of an ink discharge recording apparatus (ink jet recording apparatus) including a liquid supplying device (ink supplying device) in accordance of a second embodiment of the present invention.

FIG. 2 is a view that schematically shows a liquid discharge recording apparatus that includes a liquid supplying device in accordance with a second embodiment of the present invention. For the ink supply system sown in FIG. 1, due to the temperature rise in the recording apparatus, increase of temperature outside, or the like, the air accumulated in the ink tank expands, and then, ink in the ink tank tends to flow outside the ink tank, thus flowing into the atmosphere releasing tube. Therefore, in accordance with the first embodiment, the height of the opening end of the atmosphere releasing tube is set in anticipation of a sufficient pressure rise in the ink tank so as not to allow ink to overflow from the nozzle or the atmosphere releasing tube. However, in the case where only the atmosphere releasing tube exists as in the first embodiment, there is a possibility that ink flies out from the opening end of the atmosphere releasing tube if the inner pressure of the ink tank rises abruptly, and stains the inside of the recording apparatus.

Now, therefore, in accordance with the present embodiment, an ink buffer chamber 29, which serves as the ink receptacle for provisionally retaining ink that overflows from the ink tank 22, is connected with the end portion of the atmosphere releasing tube 26 folded upward as shown in FIG. 2. Then, an atmosphere-releasing hole 33 is provided for the uppermost part of the sidewall of the ink buffer chamber 29. With the structure thus arranged, the ink buffer chamber 29 can suppress the flying out of ink before it flies out to the interior of the apparatus due to the expansion of air in the ink tank.

Figure 3:
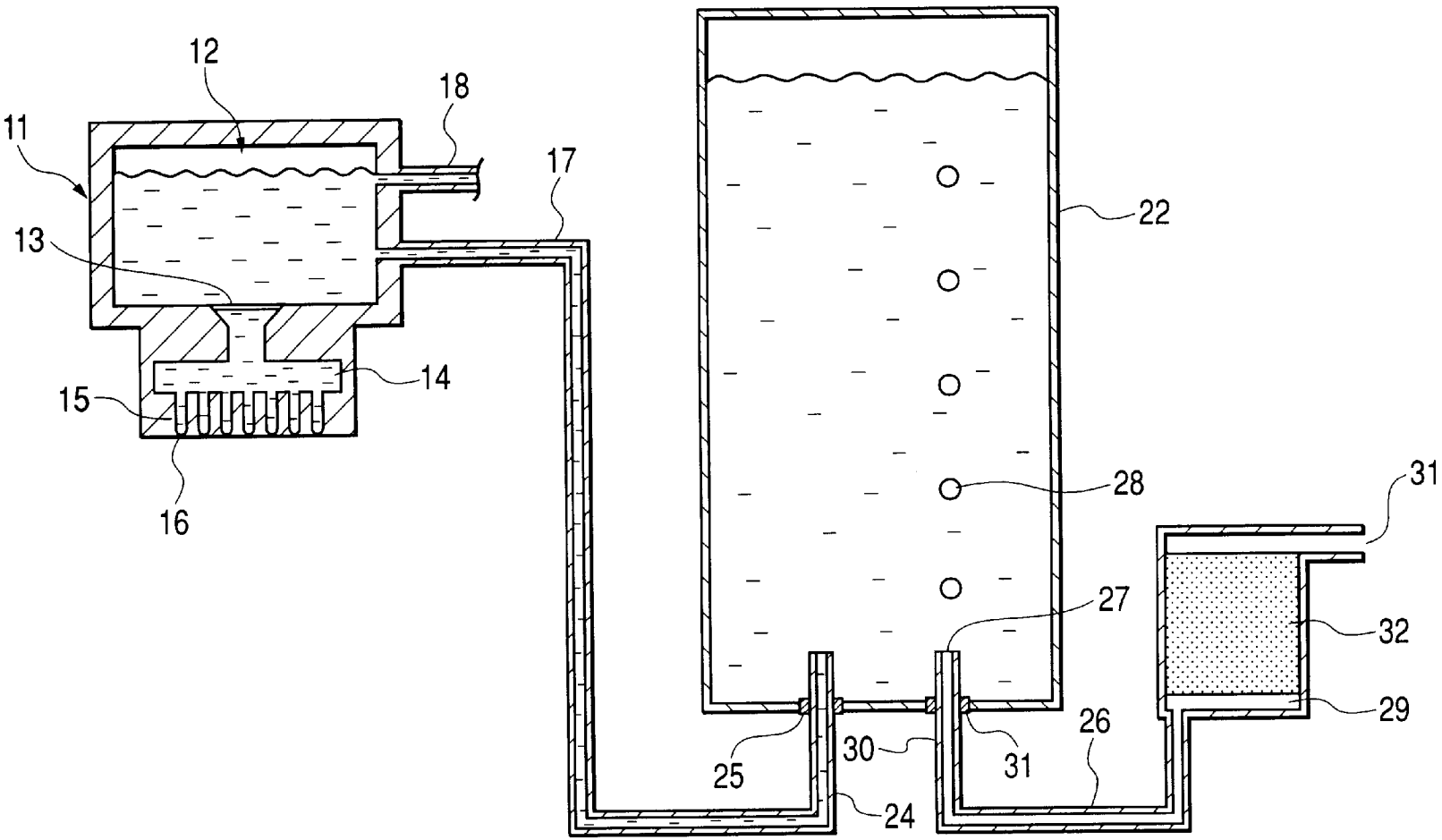
FIG. 3 is a view that shows the variational example of the ink buffer chamber represented in FIG. 2.
Figure 4:
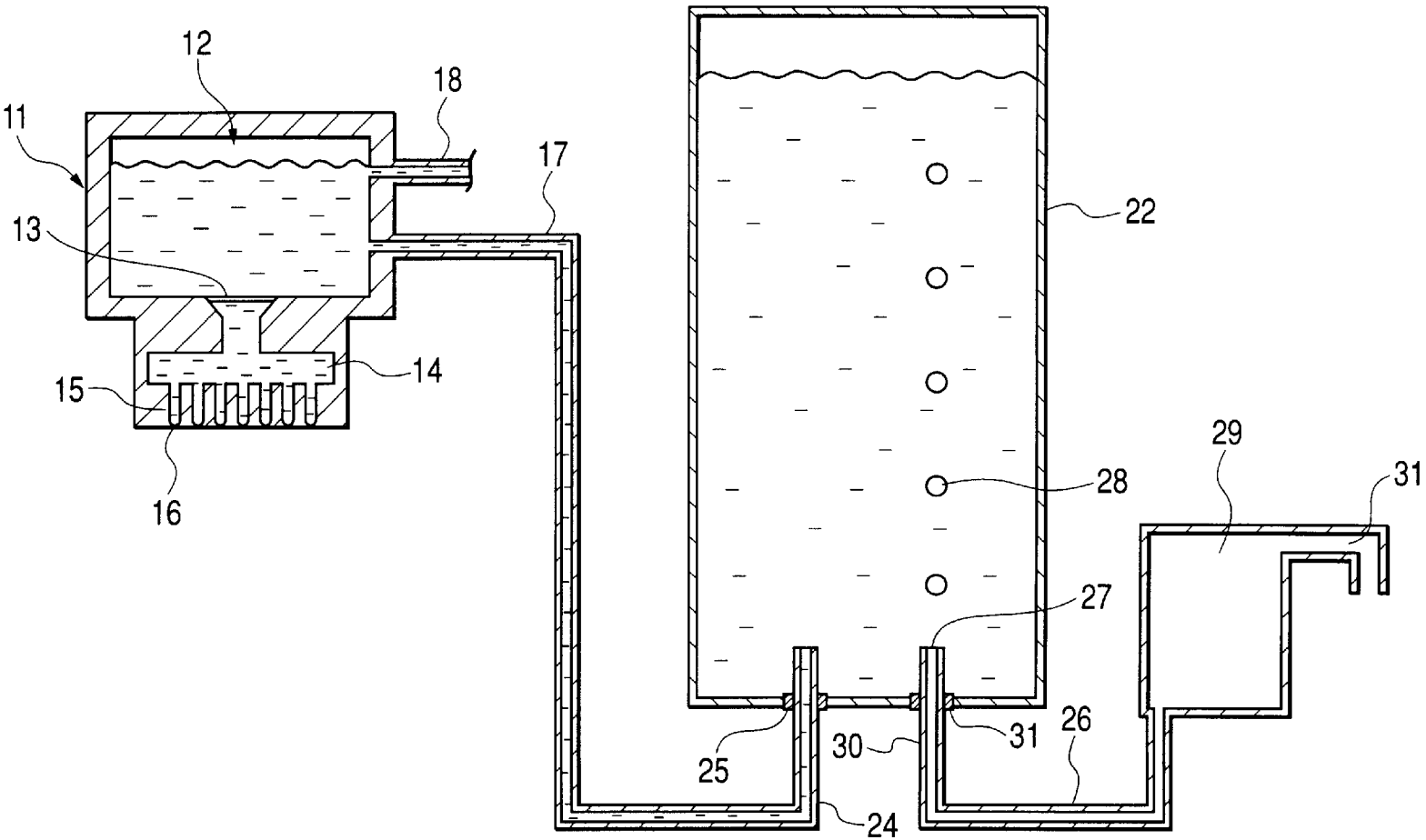
FIG. 4 is a view that shows the variational example of the ink buffer chamber represented in FIG. 2.

To provide a more preferable ink system, it may be possible to arrange an ink absorbent (sponge, for instance) 32 in the ink buffer chamber 29 having the atmosphere opening hole 33 so as to control ink from moving freely in the ink buffer chamber 29 as shown in FIG. 3. Or, as shown in FIG. 4, with the downward arrangement of the atmosphere opening hole 33 provided for the ink buffer chamber 29, it may be possible to prevent dust particles in the air outside from being mixed in ink in the ink supply system.

Next, the description will be made of the volume of the ink buffer chamber 29 that serves as the receptacle for ink that may overflow from the ink tank 22 due to the environmental changes.

Given the volume of the ink tank 22 as V (constant); the volume of ink in the ink tank 22 as Vi; the air accumulated in the ink tank 22 as Va; and the volume of the ink buffer chamber 29 as $V_B$, the V (constant)=Vi+Va.

Generally, the ink jet recording apparatus that includes the ink supply system of the present embodiment is used at an environmental temperature of 5 to 35° C. Further, assuming that the temperature rise in the recording apparatus is 15° C., the temperature of the ink tank is caused to rise only up to 50° C., not more than that, but to be on the safe side, 10° C. is added for consideration, and now, a case where it rises up to 60° C. at the maximum is discussed.

Now, it is assumed that the temperature of the ink jet recording apparatus, which has been used at a temperature of 5° C., is raised up to 60° C. Then, the volume Va' of the air in the ink tank 22 at that time is:

Va'=Va·(273+60)/(273+5), which is nearly equal to 1.2 Va. Therefore, a portion the air of 0.2 Va begins to flow out toward the ink buffer chamber 29.

For the maximum value of the amount of ink that flows out, the amount of ink, which is equivalent to the 0.2 Va that flows out, should remain in the ink tank 22. Then, there is a possibility that the amount of ink that flows out from the ink tank 22 becomes the largest when the Va=(5/6) V, where Vi=0.2 Va V−Va=0.2 Va, and therefore, Va=(1/1.2) V=(5/6) V. The maximum value thereof is 0.2 Va=(1/5)×(5/6) V=(1/6) V. Thus, the volume $V_B$ of the ink buffer chamber 29 needs to satisfy the relationship of $V_B \geqq (1/6)$ V.

Further, for the present embodiment, too, (1) the positional relations between the discharge port of nozzle 15 and the leading end 26*b* of the atmosphere releasing tube 26 of the ink tank 22 is set at H1>H2; (2) the positional relations between the leading end 26*b* of the atmosphere releasing pipe 26 of the ink tank 22 and the atmosphere opening hole 31 of the ink buffer chamber 29 is set at H2<H3'; and (3) the positional relations between the discharge port of the nozzle 15 and the atmosphere opening hole 31 of the ink buffer chamber 29 is set at H1>H3' for the same reasons given for the first embodiment.

Here, with reference to FIG. 5 to FIG. 7, the description will be made of the ink flow in the liquid supplying device shown in FIG. 2 as to A: at the time of usual recording, B: the temperature outside rises in a state where the recording operation is at rest, and C, at the time of starting the recording operation in a state where ink resides in the ink buffer chamber 29 due to the temperature outside having risen, respectively.

A. At the Time of Usual Recording.

Before recording (the condition shown in FIG. 2), force exerted by the meniscus 16 of the nozzle 15 is in balance with force exerted by the meniscus 27 in the atmosphere releasing tube 26. At this juncture, the ink buffer chamber 29 is empty (step S1 in FIG. 5).

Figure 5:
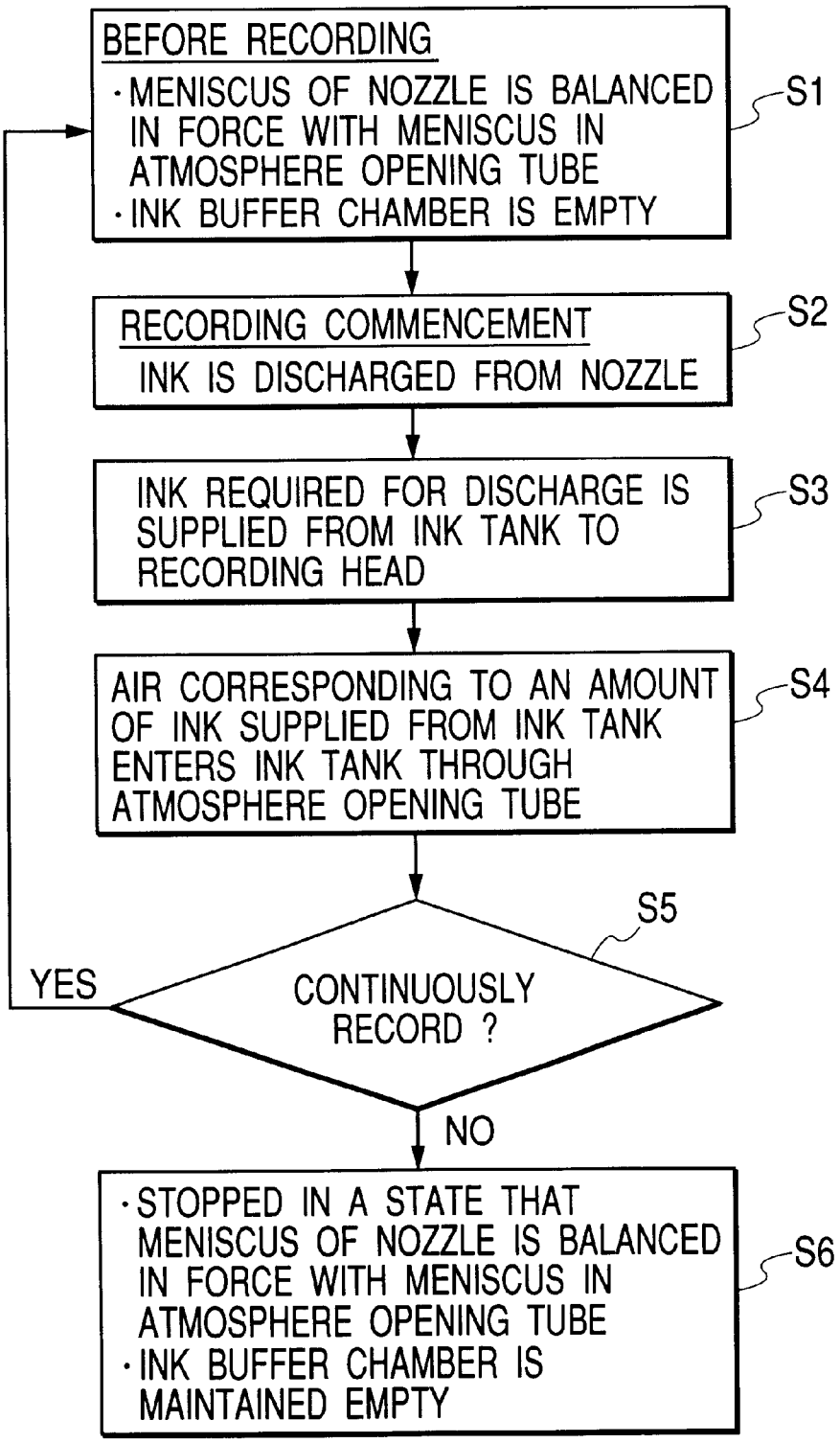
FIG. 5 is a flowchart that illustrates the ink flow in the ink supplying device shown in FIG. 2 when the recording head executes the usual recording operation.

Ink needed for discharging ink from the nozzle 15 is supplied from the ink tnak 22 to the recording head 11 (step S3 in FIG. 5).

When the recording operation begins, ink is discharged from the nozzle 15 (step S2 in FIG. 5).

Then, the air is induced into the ink tank 22 from the atmosphere releasing tube 26 corresponding to the amount of ink supplied from the ink tank 22 (step S4 in FIG. 5).

When the recording operation continues, stages from the step S2 to the step S4 are repeated (step S5 in FIG. 5). On the other hand, if the recording operation does not continue, force exerted by the meniscus 16 of the nozzle 15 and force exerted by the meniscus 27 of the atmosphere releasing tube 26 are kept still in a state of equilibrium. At this juncture, the ink buffer chamber 29 is still empty (step S6 in FIG. 5).

B. When the Temperature in the Recording Apparatus, the Temperature Outside, or the Like Rises While the Recording Operation is at Rest.

In a state of the recording being at rest (the condition shown in FIG. 2), force exerted by the meniscus 16 of the nozzle 15 is in balance with force exerted by the meniscus 27 in the atmosphere releasing tube 26. At this juncture, the ink buffer chamber 29 is empty (step S11 in FIG. 6).

Figure 6:
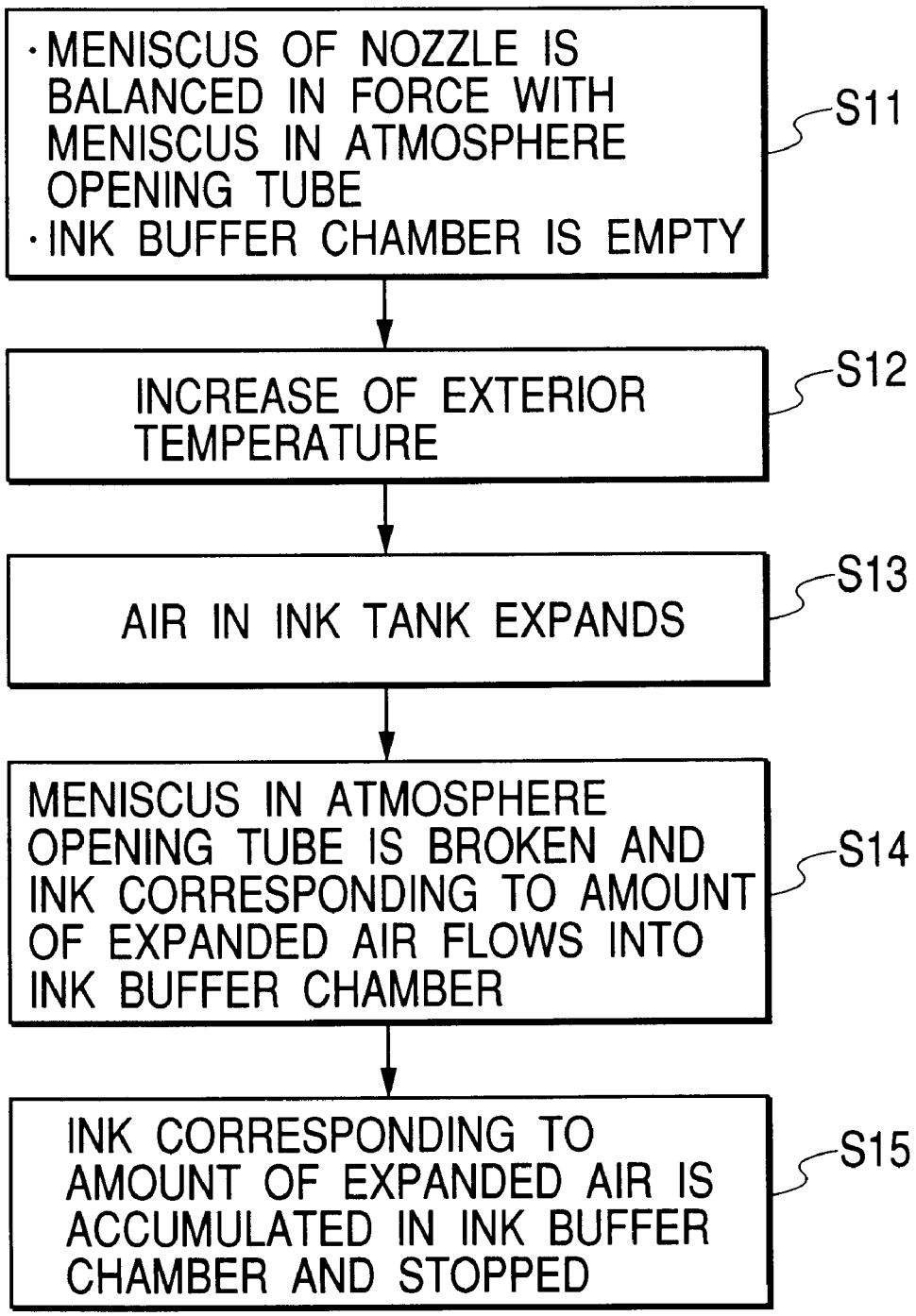
FIG. 6 is a flowchart that illustrates the ink flow in the ink supplying device shown in FIG. 2 when the external atmospheric temperature rises in a state where the recording head is not engaged in recording operation.

When the temperature outside rises, the air accumulated in the ink tank 22 expands (step S12 and step S13 in FIG. 6). The meniscus 27 in the atmosphere releasing tube 26 is broken, and ink in an amount, which is equivalent to the portion of the expanded air, flows out to the ink buffer chamber 29 (step S14 in FIG. 6).

Ink in an amount equivalent to the portion of expanded air is accumulated in the ink buffer chamber 29, and stops at a position where it does not leak from the atmosphere opening hole 31 (step S15 in FIG. 6).

C. When the Recording Operation Begins in a State Where Ink is Accumulated in the Ink Buffer Chamber 29 Due to the Temperature Outside or the Like Having Risen.

In the state of the step S15 in FIG. 6, the ink buffer chamber 29 is filled with ink. At this juncture, the meniscus 16 of the nozzle 15 is positioned higher than the water level of ink in the ink buffer chamber 29, and held by the water-head difference portion thereof (step S21 in FIG. 7).

Figure 7:
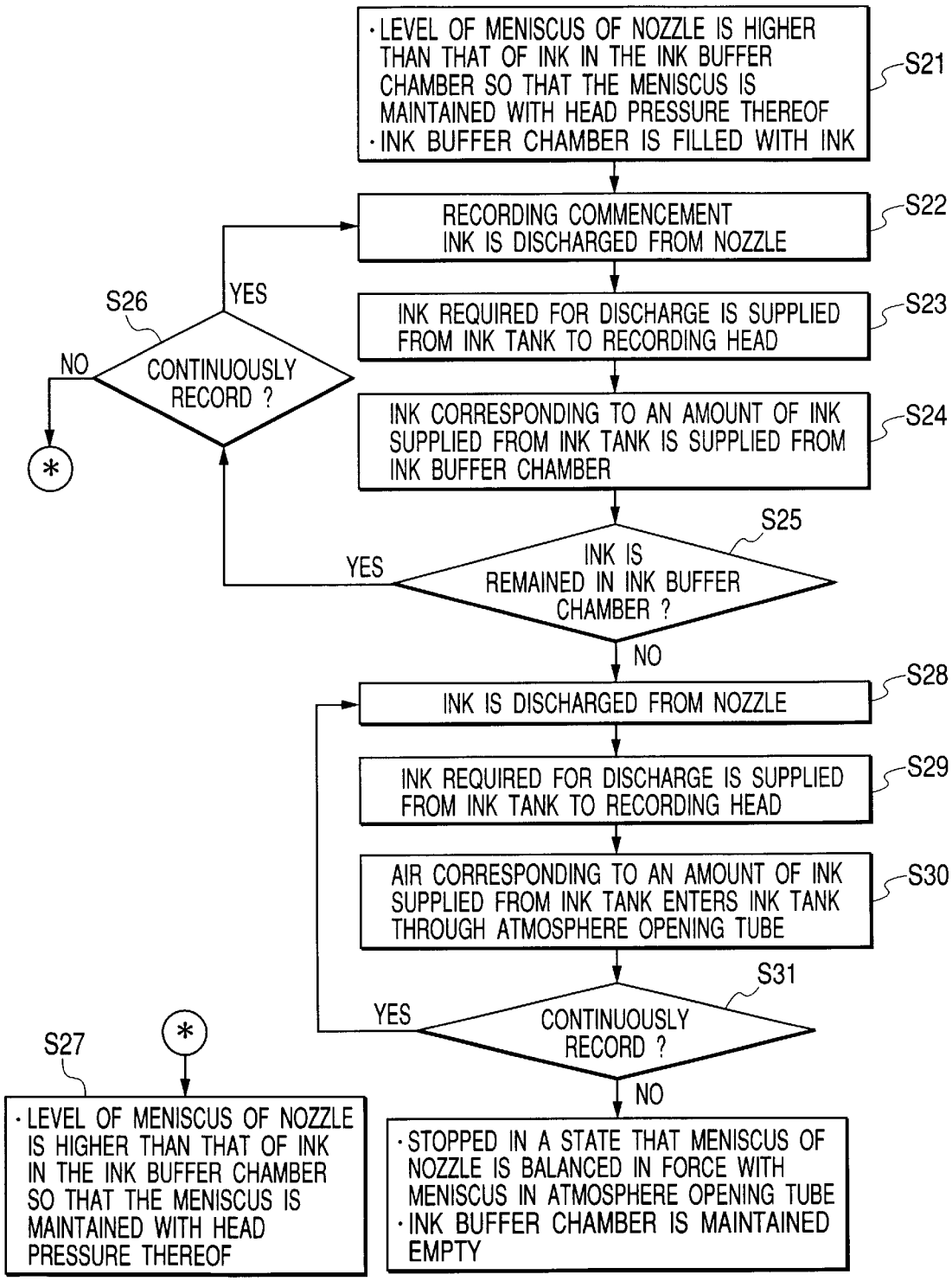
FIG. 7 is a flowchart that illustrates the ink flow in the ink supplying device shown in FIG. 2 when a recording operation begins in a state where the external atmospheric temperature rises and ink resides in the ink buffer chamber.

When the recording operation begins, ink is discharged from the nozzle 15 (step S22 in FIG. 7).

Ink needed for discharge from the nozzle 15 is supplied from the ink tank 22 to the recording head 11 (step S23 in FIG. 7).

Ink, which corresponds to the amount of ink supplied from the ink tank 22 to the recording head 11, is supplied from the ink buffer chamber 29 to the ink tank 22 (step S24 in FIG. 7).

When the recording operation continues in a state where ink remains in the ink buffer chamber 29, the stages from the step S2 to S4 are repeated (step S25 and step S26 in FIG. 7). When the recording operation stops in a state where ink remains in the buffer chamber 29, the meniscus 16 of the nozzle 15 is positioned higher than the water level of ink in the ink buffer chamber 29, and held by the portion of the water-head difference (step S27 in FIG. 7).

Also, when ink is discharged from the nozzle 15 in a state where no ink remains in the ink buffer chamber 29, ink needed for discharge from the nozzle 15 is supplied from the ink tank 22 to the recording head 11, and the air, which corresponds to the amount of ink supplied from the ink tank 22 to the recording head 11 is induced into the ink tank 22 from the atmosphere releasing tube 26 (Steps S28 to S30 in FIG. 7).

When the recording operation continues, the stages from the step S2 to the step S4 are repeated (step S31 in FIG. 7) On the other hand, the recording operation stops, the ink flow stops in a state where force exerted by the meniscus 16 of the nozzle 15 and force exerted by the meniscus 27 in the atmosphere releasing tube 26 are in a state of equilibrium. At this juncture, the ink buffer chamber 29 is empty.

In accordance with the structure of the present embodiment, it is possible to perform the recording operation in good condition without allowing ink to overflow to the inside of the recording apparatus in any one of the cases A, B, and C described above.

In this respect, for the first and second embodiments described above, the description has been made of one piece of the ink tank 22 and one piece of the recording head 11. However, if plural ink tanks 22 and recording heads 11 should be installed in order to meet the need for use of plural kinds of ink for a color recording or the like, it is good enough if a plurality of the structures shown in FIG. 1 is installed in line for the purpose.

The present invention is applicable not only to an ink jet apparatus of serial type in which the recording head 11 reciprocates in the directions intersecting with the conveying direction of a recording medium (not shown), but also, to an ink jet recording apparatus of full-line type in which the recording head 11 has a length larger than the entire width of a recording medium, and discharges ink without traveling. Also, the structure of the recording head 11 of the present invention is not necessarily limited to those represented in the accompanying drawings. It may be possible to adopt different structures of the flow path and liquid chamber. As to the principle of ink discharge, the invention is not necessarily limited to the bubble jet method. The invention is applicable to an ink jet recording head of any structure and discharge principle.

In accordance with the present invention, a liquid supplying device, which is used for a liquid discharge recording apparatus for performing recording by use of a liquid discharge head to discharge liquid, is provided with a liquid container formed by a housing made of the material, which is not easily deformed itself, for retaining liquid to be supplied to the recording head; and first and second tubular connecting portions connected with the liquid container. The first connecting portion is connected with the recording head, and the second connecting portion is structured so as to enable an interface to exist between liquid in the second connecting portion and the air outside by arranging one end of the second connecting portion in the liquid container to be positioned lower than the height of the liquid discharge port of the recording head in the liquid supplying device, the inside of the liquid container of which is communicated with the air outside. Then, by means of force exerted by the surface tension of the meniscus formed on such interface, negative pressure is generated to the liquid discharge port of the recording head, it becomes possible to materialize stabilized discharges, because with the structure thus arranged, liquid is not allowed to drop down from the liquid discharge port of the recording head even if the surrounding temperature is greatly changed in the use environment, not to mention the normal use environment as a matter of course.

The liquid container (ink tank) used for such liquid supply systems does not need any deformation. It can simply be a housing, and there is no particular restriction for the material to be used. The manufacture is also simply effectuated at lower costs. Then, liquid (ink) can be filled in the liquid container up to its capacity. There is also no need for the provision of space around the liquid container, thus making the retaining efficiency of liquid extremely favorable. The liquid supply device is not necessarily made larger, thus contributing to saving space as a whole for the liquid discharge apparatus (ink jet recording apparatus) having a liquid supplying device provided therefor. Particularly, for a liquid discharge recording apparatus capable of recording in a large quantity or performing fine color recording, which requires a large amount or various kinds of liquids, it is extremely effective to adopt the structure by the application of the present invention so as to avoid making the apparatus larger.

Also, with the provision of a buffer chamber, which functions to be receptacle for liquid pushed out of the liquid container due to the air in the liquid container, which expands by the temperature rise, between the aforesaid second connecting portion of the liquid container and the atmosphere opening hole, it becomes possible to prevent the inside of the recording apparatus from being stained by liquid contained in the liquid container.

What is claimed is:

1. A liquid supplying device for supplying liquid to a recording head for discharging liquid, comprising:

a liquid container for containing liquid to be supplied to said recording head;

a first connecting portion for connecting said recording head and said liquid container; and a second connecting portion having one end thereof in said liquid container, and the other end thereof being open to the air outside, wherein the one end of said second connecting portion connected with said liquid container is positioned lower than the height of a liquid discharge port of said recording head, and an interface between liquid and the air outside exists in said second connecting portion, and by the surface tension of meniscus formed on said interface, negative pressure is generated against the liquid discharge port of said recording head; and wherein said first connecting portion and said second connecting portion extend from a bottom face of said liquid container downward, and are bent upward on the way therefrom, respectively.

2. A liquid supplying device according to claim 1, wherein the other end of said second connecting portion opened to the air outside is positioned higher than the one end thereof.

3. A liquid supplying device according to claim 2, wherein the other end of said second connecting portion opened to the air outside is positioned lower than the height of the liquid discharge port of said recording head.

4. A liquid supplying device according to claim 1, wherein a buffer chamber is installed between both ends of said second connecting portion to provisionally retain liquid overflowing from said liquid container.

5. A liquid supplying device according to claim 1, wherein said interface in said second connecting portion moves in accordance with the pressure changes inside said liquid container and inside said recording head to keep said negative pressure constantly.

6. A liquid supplying device according to claim 1, wherein said first connecting portion supplies liquid from said liquid container to said recording head when liquid in said recording head is consumed, and said second connecting portion induces the air outside into said liquid container when pressure in said liquid container is reduced.

* * * * *